US011795041B2

(12) United States Patent
Bacon et al.

(10) Patent No.: US 11,795,041 B2
(45) Date of Patent: Oct. 24, 2023

(54) SCISSOR ARM LIFT ASSEMBLY AND METHOD OF OPERATING THE SAME

(71) Applicant: Herkules Equipment Corporation, Walled Lake, MI (US)

(72) Inventors: Todd John Bacon, Northville, MI (US); Scott Francis Wilhelm, Brighton, MI (US); Leigh Nelson Gaither, Taylor, MI (US)

(73) Assignee: Herkules Equipment Corporation, Walled Lake, MI (US)

( * ) Notice: Subject to any disclaimer, the term of this patent is extended or adjusted under 35 U.S.C. 154(b) by 44 days.

(21) Appl. No.: 17/340,992

(22) Filed: Jun. 7, 2021

(65) Prior Publication Data

US 2022/0388821 A1 Dec. 8, 2022

(51) Int. Cl.
*B66F 7/02* (2006.01)
*B66F 7/22* (2006.01)
*B66F 7/06* (2006.01)

(52) U.S. Cl.
CPC ..... *B66F 7/02* (2013.01); *B66F 7/0625* (2013.01); *B66F 7/0666* (2013.01); *B66F 7/22* (2013.01)

(58) Field of Classification Search
CPC ..... B66F 3/00; B66F 3/06; B66F 3/22; B66F 7/00; B66F 7/02; B66F 7/22; B66F 7/246; B66F 7/06; B66F 7/0625; B66F 7/0666; B66F 7/065; B66F 7/12; B62B 2203/10; B62B 2206/06; F16M 2200/061
USPC ..... 254/4 C, 4 R, 47, 122, 123, 124, 125, 254/126, 127, 202, 208, 212
See application file for complete search history.

(56) References Cited

U.S. PATENT DOCUMENTS 5,056,626 A * 10/1991 Mayr ..... B66F 11/042 187/244
8,052,120 B2 11/2011 Bacon

FOREIGN PATENT DOCUMENTS

CN 105060169 A * 11/2015
DE 102019131985 A1 * 5/2021 ..... B66F 7/0625

OTHER PUBLICATIONS

DE102019131985—Machine Translation (Year: 2021).*
CN105060169—Machine Translation (Year: 2015).*
U.S. Appl. No. 16/840,870, filed Apr. 6, 2020.

* cited by examiner

*Primary Examiner* — Lee D Wilson
*Assistant Examiner* — Alberto Saenz
(74) *Attorney, Agent, or Firm* — Howard & Howard Attorneys PLLC

(57) ABSTRACT

A lift assembly including a platform movable to a raised position, a lowered position, and an intermediate position between the raised and lowered positions. A scissor arm system defines a cavity beneath the platform. The scissor arm system includes a pair of scissor arms pivotably connected to each other. The scissor arm system has opposed first and second ends with the first ends of the scissor arm system being coupled to the platform. A stanchion guides the platform between the raised and lowered positions. The stanchion extends from a first stanchion end to a second stanchion end above the first stanchion end. A drive mechanism is mounted to the platform to move with the platform. A flexible member is coupled to the stanchion and the drive mechanism. The drive mechanism winds and unwinds the flexible member to move the platform between the raised and lowered positions.

19 Claims, 11 Drawing Sheets

SCISSOR ARM LIFT ASSEMBLY AND METHOD OF OPERATING THE SAME

BACKGROUND

The present application generally relates to lifting assemblies including lifts, jacks, and lift or lifting platforms. Industrial lifting assemblies provide a powerful mechanism to lift and or otherwise orientate machinery, manufactured parts, pallets, boxes and the like.

A manufacturer, distributor, or customer of lift assemblies may maintain and/or purchase an extremely large inventory of parts to enable the manufacture, assembly, and use of a large set of products. To support the continuous operation of an assembly line in such environments, parts or components may be replenished continuously and in a timely manner. Since there are space restrictions for the stations along the assembly line, the parts or components cannot be stock piled and may be restocked in near real-time and prior to demand. It will be appreciated that this places a high premium on logistical control and movement of parts within the manufacturing facility and bottlenecks in the supply of fresh parts or components can arise.

While lift assemblies are routinely utilized to assist in the performance of a variety of different types of mass manufacturing implementations, there is a need in the art to continuously improve such lift assemblies.

SUMMARY

The present disclosure relates generally to a lift assembly. The lift assembly includes a platform that is movable to a raised position, a lowered position, and at least one intermediate position between the raised and lowered positions. The lift assembly also includes a scissor arm system. The scissor arm system defines a cavity bounded above by the platform and has at least one pair of scissor arms pivotably connected to each other. The scissor arm system has opposed first and second ends with the first ends of the scissor arm system being coupled to the platform. The lift assembly further includes a stanchion extending from a first stanchion end to a second stanchion end above the first stanchion end. The stanchion guides the platform between the raised and lowered positions. A flexible member is coupled to the stanchion. A drive mechanism is mounted to the platform to move with the platform. The drive mechanism is coupled to the flexible member to wind and unwind the flexible member to move the platform between the raised and lowered positions.

The present disclosure also relates generally to a method of moving a platform of a lift assembly. The platform is supported by a flexible member coupled to a stanchion. The platform is supported above a scissor arm system having first and second scissor arms pivotably connected to each other. The first scissor arm is pivotably coupled to the stanchion. The scissor arm system defines a cavity beneath the platform. The method comprising the step of winding the flexible member to raise the platform relative to the stanchion while the first scissor arm pivots relative to the second scissor arm and the stanchion.

DETAILED DESCRIPTION

Figure 1:
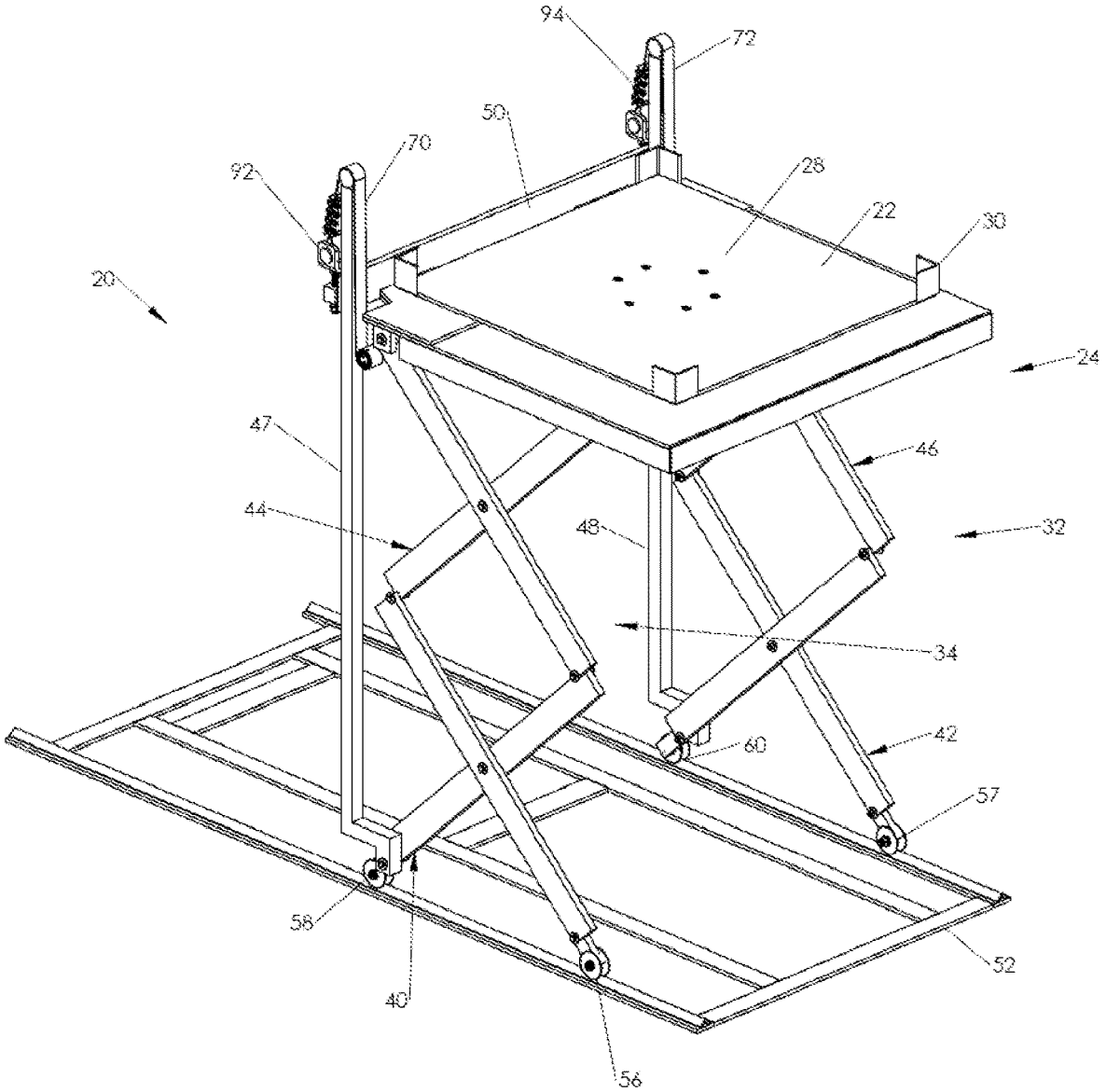
FIG. 1 is a perspective view of a lift assembly.
Figure 2:
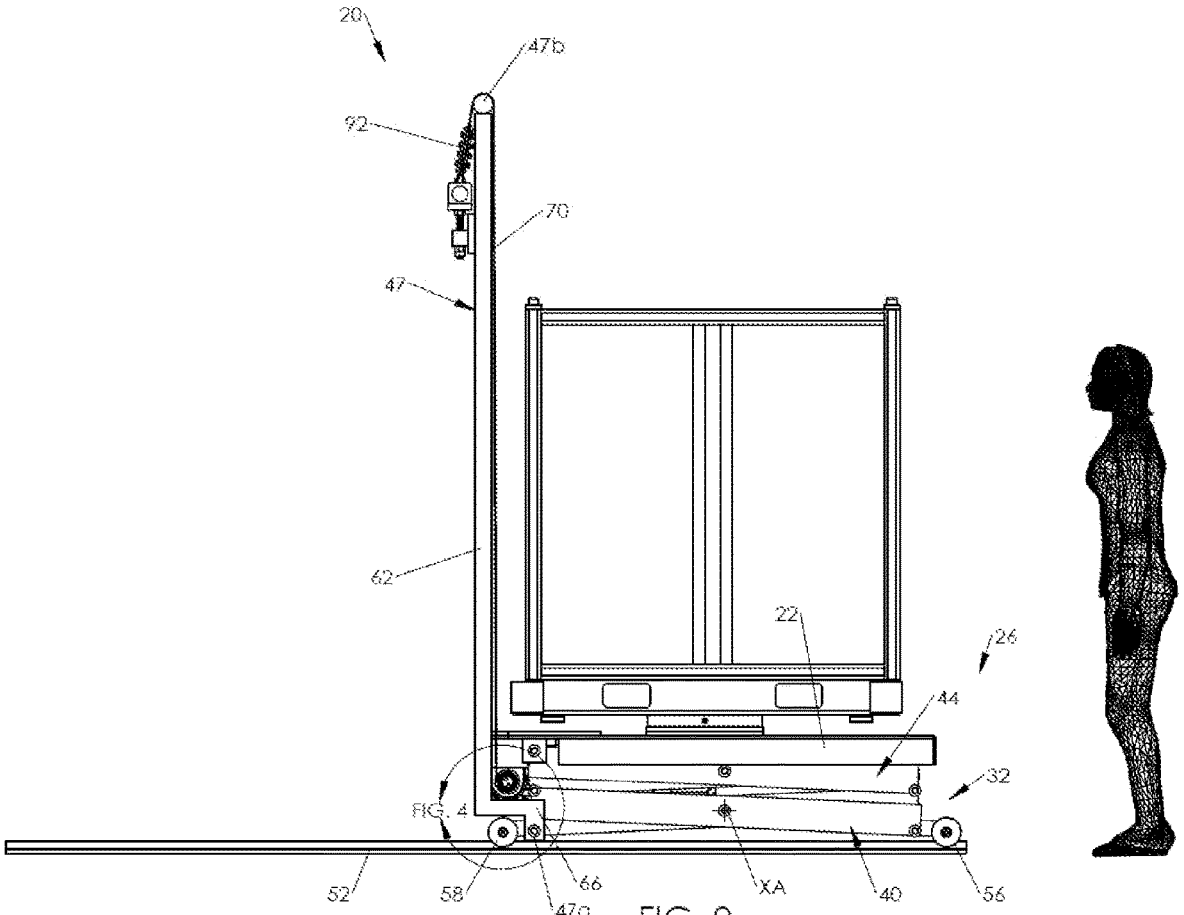
FIG. 2 is a side elevation view of the lift assembly including a platform in a lowered position.
Figure 3:
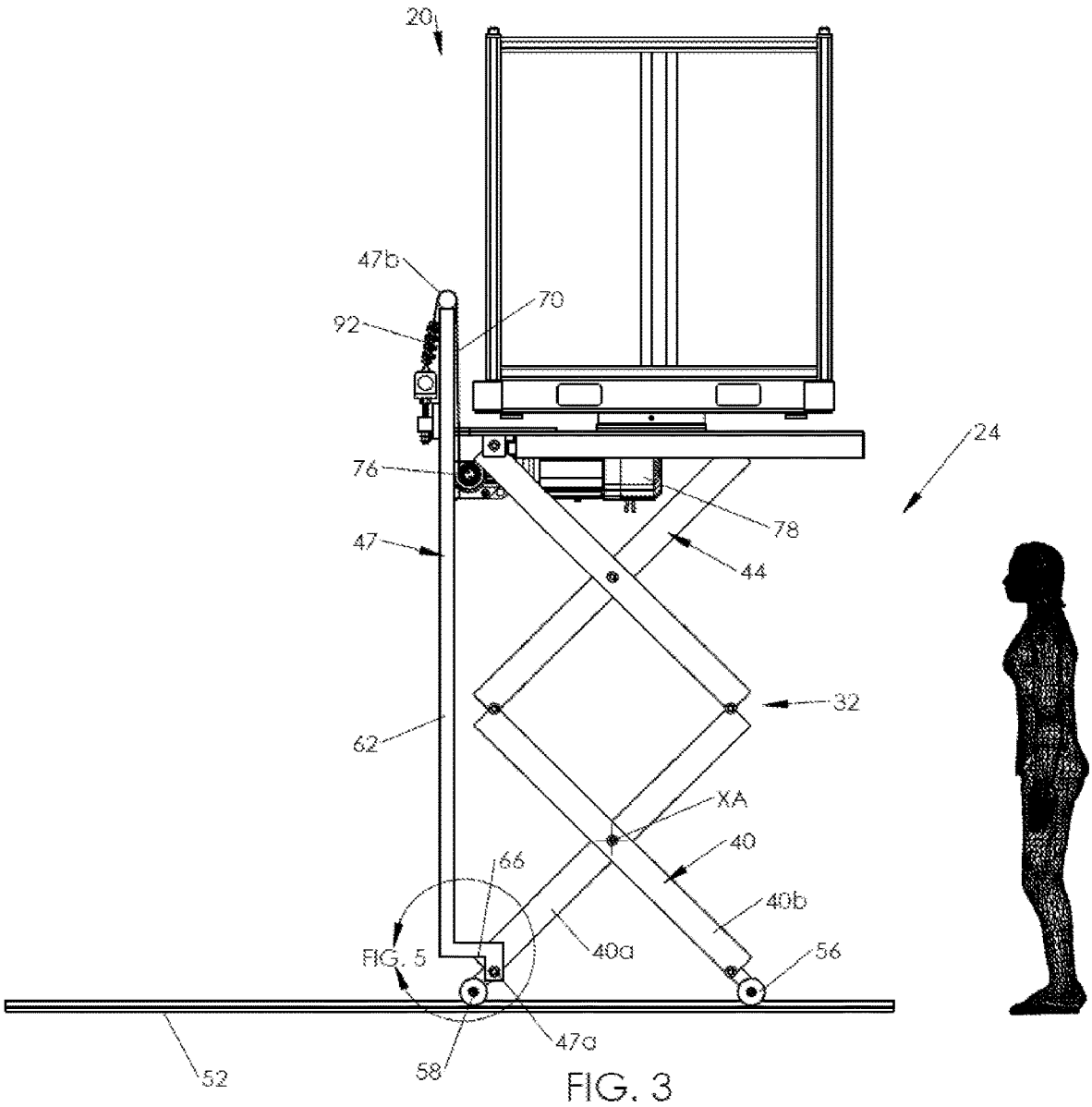
FIG. 3 is a side elevation view of the lift assembly including the platform in a raised position.

FIG. 1 illustrates a lift assembly 20. The lift assembly 20 includes a platform 22 for supporting a load. The platform 22 is movable to a raised position 24 shown in FIGS. 1 and 3, a lowered position 26 shown in FIG. 2, and at least one intermediate position between the raised and lowered positions 24, 26. The platform 22 has a planar surface 28 to support a load. In some configurations, the platform 22 includes projections 30 extending upwardly to guide or otherwise assist in locating the load to a specific position on the platform 22. The platform 22 may comprise a rotary platform. One exemplary rotary platform is disclosed in U.S. Pat. No. 8,052,120, filed May 5, 2009, the contents of which are hereby incorporated by reference in its entirety.

Figure 11:
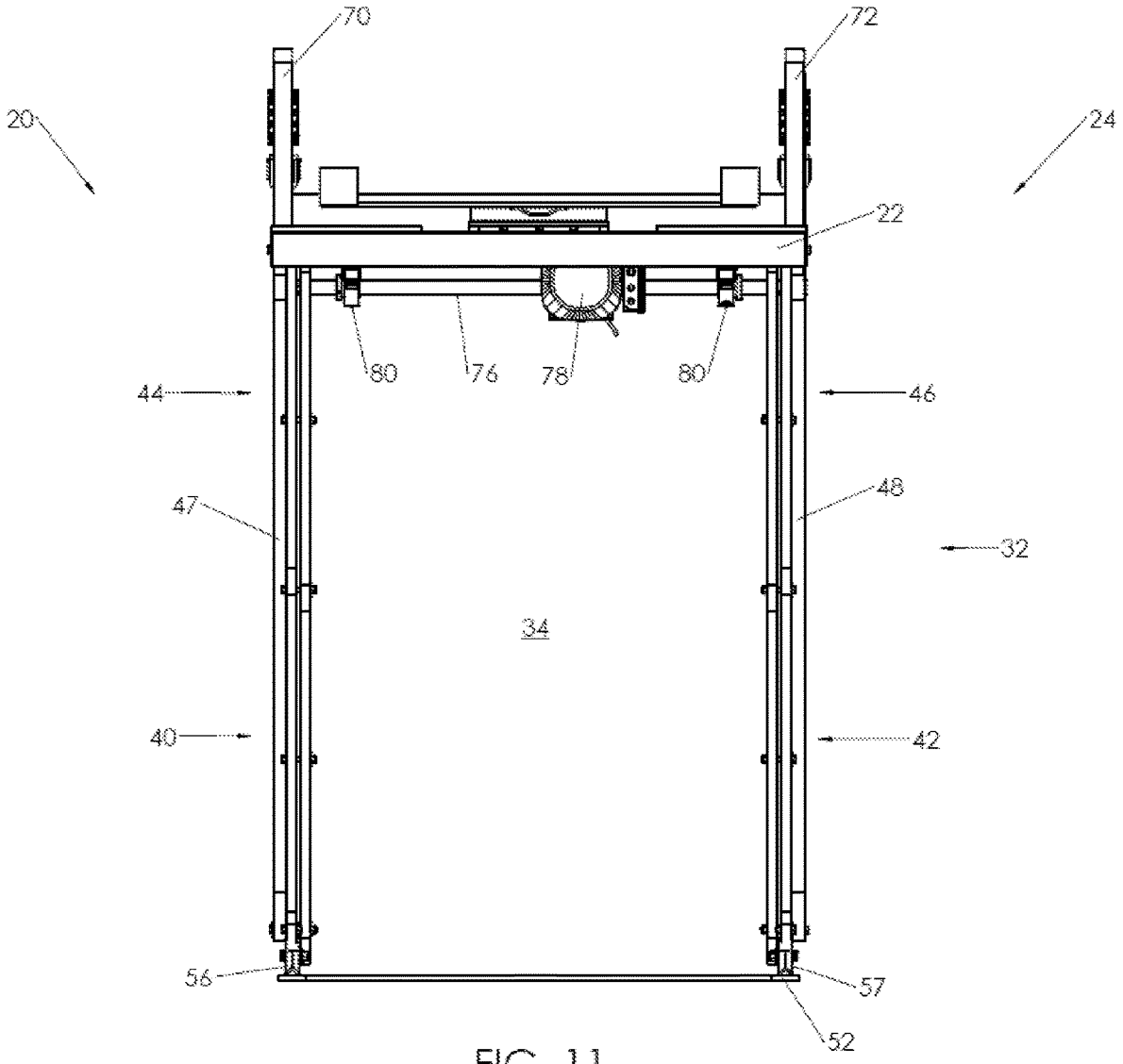
FIG. 11 is a front elevation view of the lift assembly including the platform in the raised position.

As shown in FIG. 11, the lift assembly 20 also includes a scissor arm system 32. The scissor arm system 32 defines a cavity 34 bounded above by the platform 22. The scissor arm system 32 has at least one pair of scissor arms. The scissor arms are pivotably connected to each other. The scissor arm system 32 has opposed first and second ends 36, 38. The first ends 36 of the scissor arm system 32 are coupled to the platform 22.

As shown in the configuration illustrated in FIG. 1, the scissor arm system 32 includes a first pair of scissor arms 40, a second pair of scissor arms 42, a third pair of scissor arms 44, and a fourth pair of scissor arms 46. The first and third pairs of scissor arms 40, 44 are coupled in series and the second and fourth pairs of scissor arms 42, 46 are coupled in series. In other words, first and third pairs of scissor arms 40, 44 are stacked upon one another and the second and fourth pairs of scissor arms 42, 46 are stacked upon one another. The first and third pairs of scissor arms 40, 44 are spaced from the second and fourth pairs of scissor arms 42, 46 to define the cavity 34. The cavity 34 defined beneath the platform 22 and between pairs of scissor arms 40, 42, 44, 46 may be clear to permit objects to pass beneath the platform 22 and between the pairs of scissor arms 40, 42, 44, 46. Each scissor arm of each pair of scissor arms 40, 42, 44, 46 is pivotably coupled to the other scissor arm in the respective pair of scissor arms 40, 42, 44, 46. One scissor arm from one pair of scissor arms 40, 42, 44, 46 is pivotably coupled to another scissor arm of another pair scissor arms 40, 42, 44, 46 in the same series. For instance, the first pair of scissor arms 40 includes first and second scissor arms 40*a*, 40*b* pivotably coupled to each other and the third pair of scissor arms 44 includes first and second scissor arms 44*a*, 44*b* pivotably coupled to each other. The first scissor arm 40*a* of the first pair of scissor arms 40 is pivotably coupled to the second scissor arm 44*b* of third pair of scissor arms 44. In this manner, displacement of the platform 22 between the raised and lowered positions 24, 26 may be greater than a length of a single scissor arm. The pairs of scissor arms 40, 42, 44, 46 may be collapsed when the platform 22 is in the lowered position 26 and the pairs of scissor arms 40, 42, 44, 46 may be extended when the platform 22 is in the raised position 24. It is contemplated that the second and fourth pairs of scissor arms 42, 46 are arranged in similar manner to and spaced from the first and third pairs of scissor arms 40, 44. In other configurations, the scissor arm system 32 includes only first and second pairs of scissor arms 40, 42 to define the cavity 34. In still other configurations, the scissor arm system 32 includes more than four pairs of scissor arms 40, 42, 44, 46.

As shown in FIG. 1, the lift assembly 20 further includes at least one stanchion 47, 48. In the illustrated configuration, the lift assembly 20 includes a first stanchion 47 and a second stanchion 48. Each stanchion 47, 48 extends from a first stanchion end 47*a*, 48*a* to a second stanchion end 47*b*, 48*b* above the first stanchion end 47*a*, 48*a*. The stanchions 47, 48 guide the platform 22 between the raised and lowered positions 24, 26. In alternative configurations, the lift assembly 20 includes a single stanchion. The first stanchion 47 is coupled to one of the first pair of scissor arms 40. The second stanchion 48 is spaced from the first stanchion 47 and coupled to one of the second pair of scissor arms 42. A cross-member 50 is coupled to and extends between the first and second stanchions 47, 48. The cross-member 50 is coupled near the second ends 47*b*, 48*b* of the first and second stanchions 47, 48 so that occlusion of the cavity 34 defined by the scissor arm system 32 and the platform 22 is mitigated. The cross-member 50 may provide rigidity to the first and second stanchions 47, 48.

The lift assembly 20 may also include a base 52 to support the first and second stanchions 47, 48 and the scissor arm system 32. The base 52 may have a track to guide the stanchions 47, 48 and the scissor arm system 32 along a length of the base 52. Movement of the platform 22 to the raised and lowered positions 24, 26 may be independent from movement of the stanchions 47, 48 and scissor arm system 32 moving along the base 52.

Figure 6:
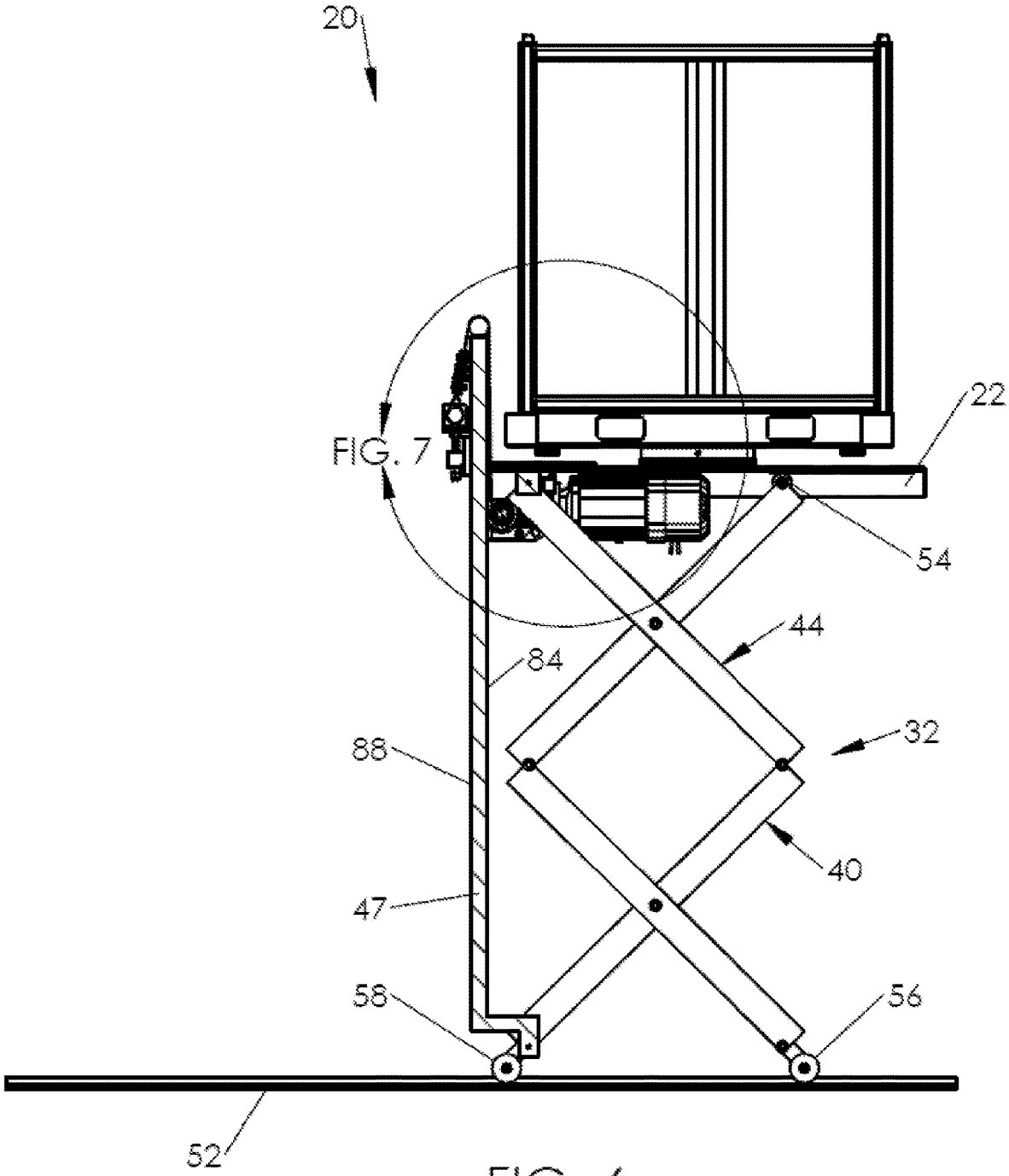
FIG. 6 is a sectional view of the lift assembly taken through a stanchion of the lift assembly.
Figure 7:
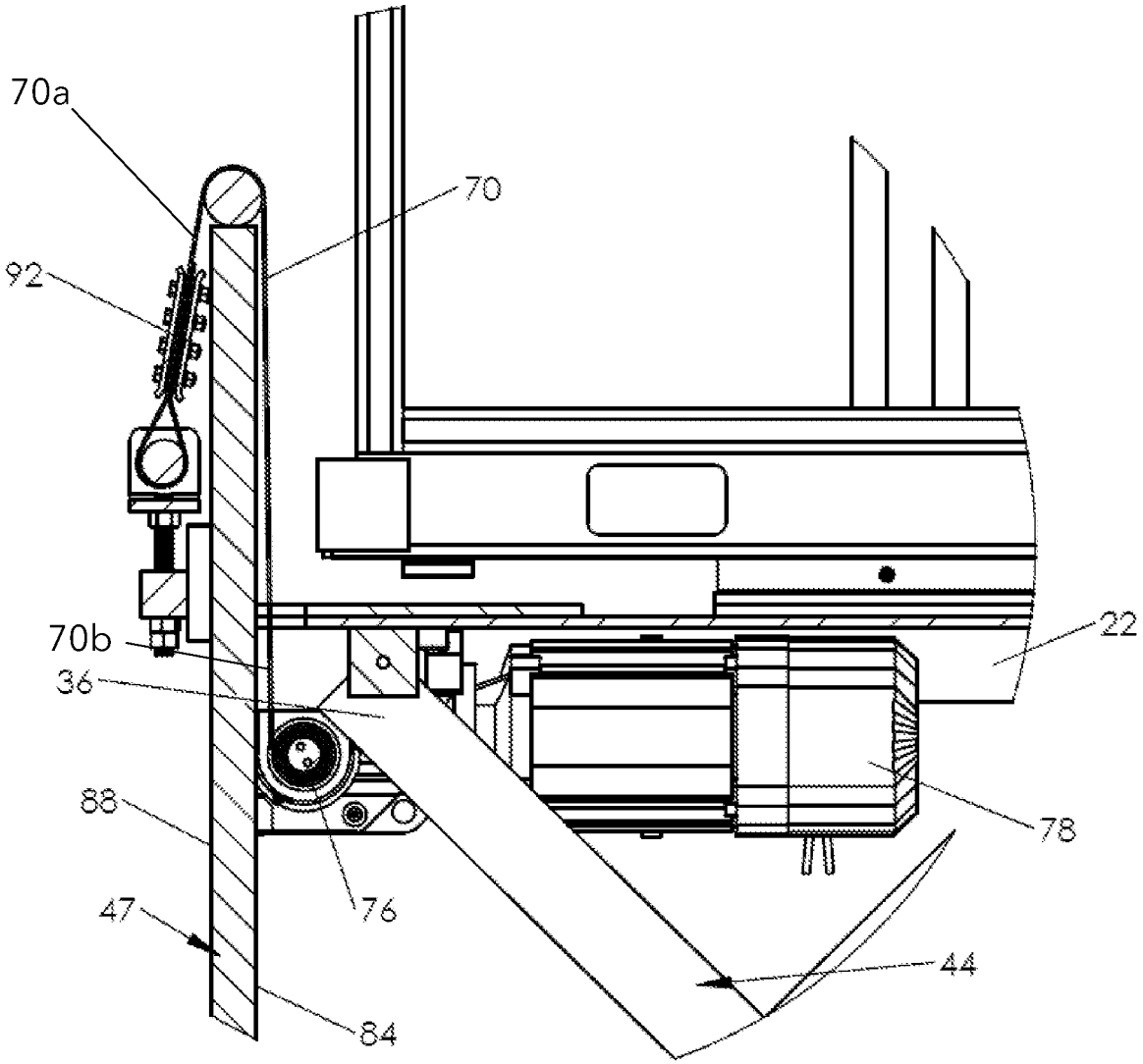
FIG. 7 is a detailed view of FIG. 6 illustrating a flexible member of the lift assembly coupled to the stanchion and a drive mechanism of the lift assembly.

As shown in FIGS. 6 and 7, the first ends 36 of the scissor arm system 32 are coupled to the platform 22. In the illustrated configuration, the first ends 36 of the scissor arm system 32 refer to ends of the scissor arms from the third and fourth pairs of scissor arms 44, 46 that are coupled to the platform 22. In other configurations including only two pairs of scissor arms spaced from each other, the first ends 36 of the scissor arm system 32 refer to scissor arms from the first and second pairs of scissor arms 40, 42 that are coupled to the platform 22. In the illustrated configuration, one of the first ends 36 of one of the scissor arms of each of the third and fourth pairs of scissor arms 44, 46 of the scissor arm system 32 are pivotably coupled to the platform 22. The other scissor arm of each of the third and fourth pairs of scissor arms 44, 46 is slidably coupled to the platform 22. More specifically, the other scissor arm may include a wheel 54 for rolling against the platform 22 that permits the scissor arm to slide relative to the platform 22 as the wheel 54 rolls against the platform 22. In some configurations, the scissor arm that is slidably coupled to the platform 22 may be coupled to the platform 22 through a pin-in-slot arrangement where the scissor arm has a pin captured in a slot of the platform 22 to limit movement of the scissor arm relative to the platform 22. The coupling arrangement of the third and fourth pairs of scissor arms 44, 46 to the platform 22 permits the pairs of scissor arms 40, 42, 44, 46 to extend and collapse to raise and lower, respectively, the platform 22 between the raised and lowered positions 24, 26.

Figure 4:
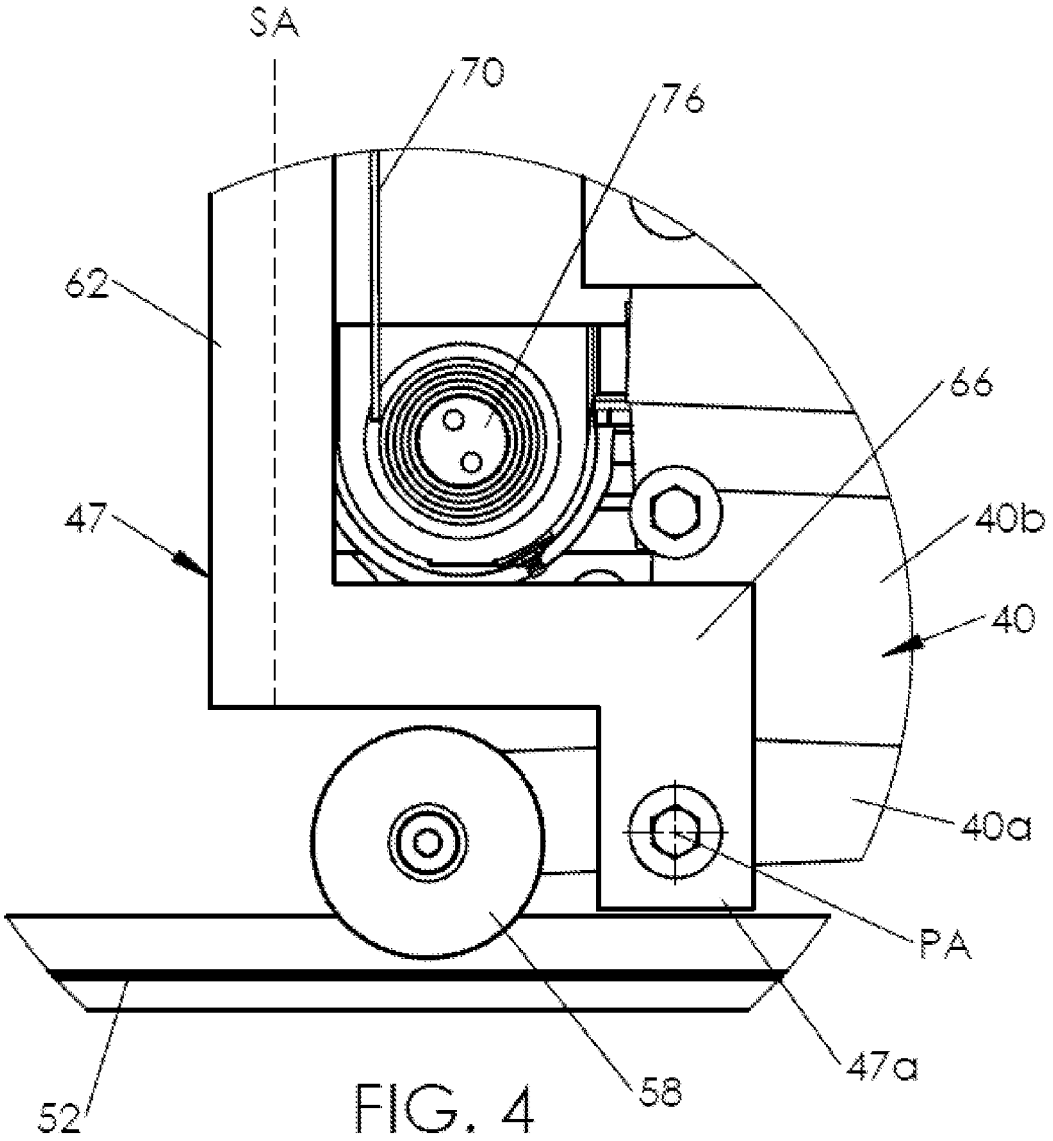
FIG. 4 is a detailed view of FIG. 2 illustrating a first end of a stanchion of the lift assembly pivotably coupled to a second end of a scissor arm system of the lift assembly when the platform is in the lowered position.
Figure 5:
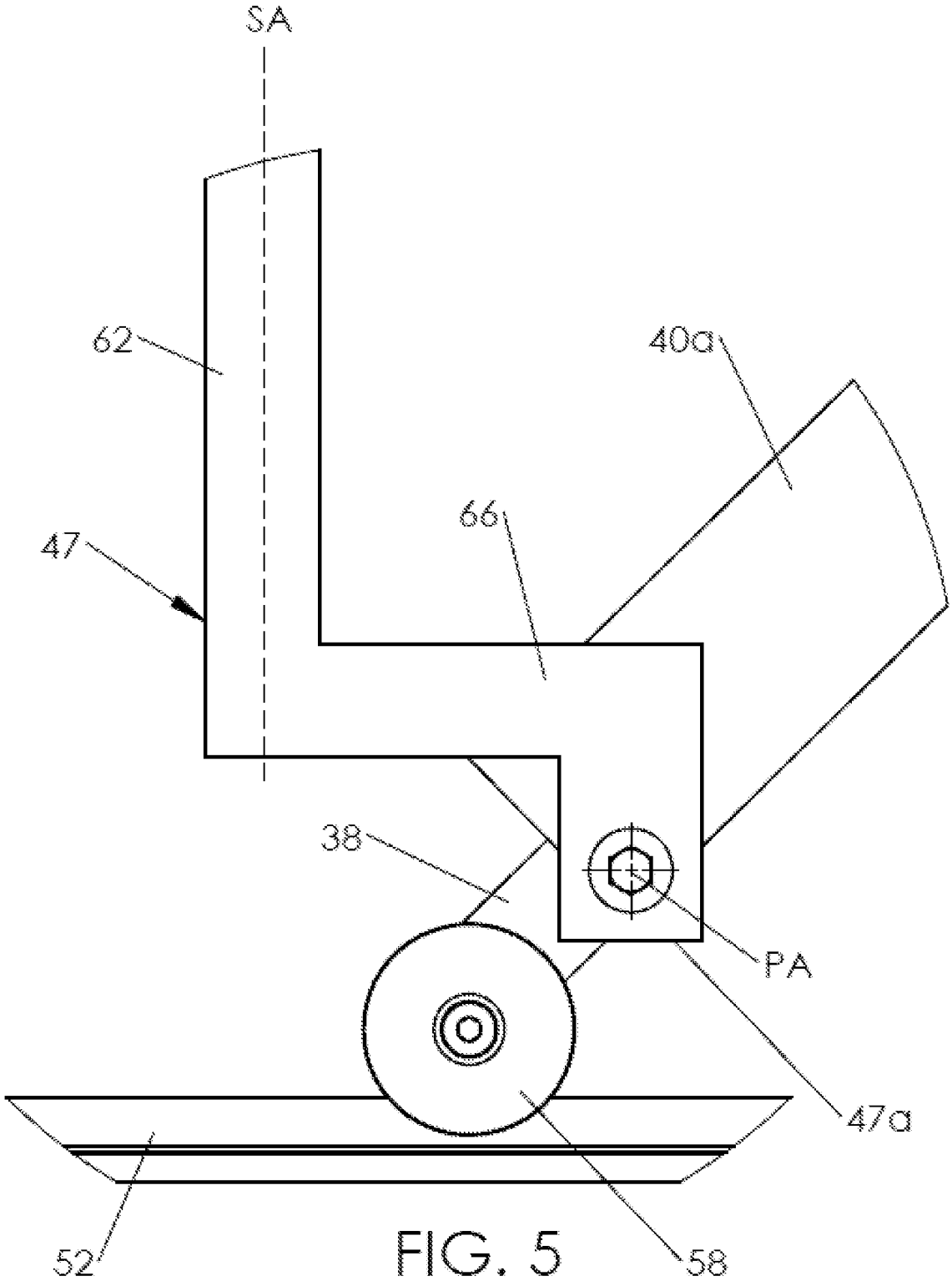
FIG. 5 is a detailed view of FIG. 3 illustrating the first end of the stanchion of the lift assembly pivotably coupled to the second end of the scissor arm system of the lift assembly when the platform is in the raised position.

As shown in FIGS. 4 and 5, one of the second ends 38 of the scissor arm system 32 is coupled to the first and second stanchions 47, 48. In the illustrated configuration, the second ends 38 of the scissor arm system 32 refer to ends of the scissor arms from the first and second pairs of scissor arms 40, 42. One of the second ends of one of the scissor arms of each of the first and second pairs of scissor arms 40, 42 of the scissor arm system 32 are pivotably coupled to the first and second stanchions 47, 48, respectively. The scissor arms are pivotably coupled to the first and second stanchions 47, 48 proximal the first ends 47*a*, 48*a* of the stanchions 47, 48 and configured to pivot about a pivot axis PA. The other scissor arm of each of the first and second pairs of scissor arms 40, 42 may be slidably coupled to the base 52 or slidable relative to a floor surface. More specifically, the other scissor arm may include a wheel 56, 57 for rolling against the base 52 or the floor surface that permits the scissor arm to slide relative to the base 52 or floor surface as the wheel 56, 57 rolls against the base 52 or floor surface. In some configurations, the scissor arm that is slidably coupled to the base 52 may be coupled to the base 52 through a pin-in-slot arrangement where the scissor arm has a pin captured in a slot of the base 52 to limit movement of the scissor arm relative to the base 52. The coupling arrangement of the first and second pairs of scissor arms 40, 42 to the stanchions 47, 48 and the base 52 and/or the floor surface permits the pairs of scissor arms 40, 42, 44, 46 to extend and collapse to raise and lower, respectively, the platform 22 between the raised and lowered positions 24, 26.

The lift assembly 20 may include first and second support feet 58, 60 to support the scissor arm system 32. The support feet 58, 60 may be pivotably coupled to one of the second ends 38 of the scissor arm system 32. Each support foot 58, 60 is coupled to one of the scissor arms of the first and second pairs of scissor arms 40, 42 such that the pivot axis PA about which the scissor arms pivot relative to respective stanchions 47, 48 is disposed between the respective support foot 58, 60 and a scissor arm axis XA (see FIGS. 2 and 3). First and second scissor arms 40*a*, 40*b*, 42*a*, 42*b* of each of the first and second pairs of scissor arms 40, 42 pivot relative to each other about the scissor arm axis XA. In the illustrated configuration, the first and second support feet 58, 60 comprise wheels to move along a floor surface or the base 52. The track of the base 52 may guide the support feet 58, 60 along the length of the base 52. The support feet 58, 60 revolve around the pivot axis PA when the scissor arms coupled to the stanchions 47, 48 pivot. The scissor arms coupled to the stanchions 47, 48 pivot relative to the stanchions 47, 48 when the platform 22 moves between the raised and lowered positions 24, 26.

In configurations where the support feet 58, 60 comprise wheels, the wheels of the support feet 58, 60 may be used in conjunction with wheels 56, 57 of the scissor arms 40, 42 to permit the lift assembly 20 to move along the track of the base 52 or along a floor surface independent of the position of the platform 22. The platform 22 may be raised or lowered while simultaneously moving forward and backward along the track of the base 52 or along the floor surface. Alternatively, the platform 22 may be disposed in the raised position 24, the lowered position 26, or an intermediate position while moving forward and backward along the track of the base 52 or along the floor surface. The feature of the lift assembly 20 moving along the track of the base independent of the vertical position of the platform 22 may be particularly advantageous to permit other objects in an environment near the lift assembly 20 to pass within the cavity 34 beneath the platform 22. Said differently, the lift assembly 20 may move along the track of the base 52 to permit the platform 22 of the lift assembly 20 to pass over other objects in the environment near the lift assembly 20.

In the configuration illustrated in FIG. 11, the scissor arm system 32 does not include any interconnecting structure between the first and second pairs of scissor arms 40, 42 except for the platform 22, and the first and second stanchions 47, 48 through the cross-member 50. Similarly, in configurations including third and fourth pairs of scissor arms 44, 46, the scissor arm system 32 may not include any interconnecting structure between the third and fourth pairs of scissor arms 44, 46 except for the platform 22, and the first and second stanchions 47, 48 through the cross-member 50. The absence of interconnecting structure in the scissor arm system 32 permit the cavity 34 to be as large as possible beneath the platform 22 in any position of the platform 22. In some configurations, the platform 22 in the raised position 24 is beneath the cross-member 50 such that there is no interconnecting structure between the first and second pairs of scissor arms 40, 42 and beneath the platform 22 in any position of the platform 22. Similarly, in configurations including third and fourth pairs of scissor arms 44, 46, the scissor arm system 32 may not include any interconnecting structure between the third and fourth pairs of scissor arms 44, 46 and beneath the platform 22 in any position of the platform 22.

As shown in FIGS. 2-5, the first and second stanchions 47, 48 may each have an elongated portion 62, 64 proximal the second end 47*b*, 48*b* of the stanchion 47, 48. The elongated portion 62, 64 extends along a stanchion axis SA. The stanchion axis SA is generally transverse to the planar surface of the platform 22. The platform 22 moves along the elongated portions 62, 64 of the stanchions 47, 48 while moving between the raised and lowered positions 24, 26.

The first and second stanchions 47, 48 may also each have a support portion 66, 68 proximal the first end 47*a*, 48*a* of the stanchion 47, 48. The support portion 66, 68 extends forward away from the stanchion axis SA with one of the second ends 38 of the scissor arm system 32 pivotably coupled to the support portion 66, 68.

Figure 8:
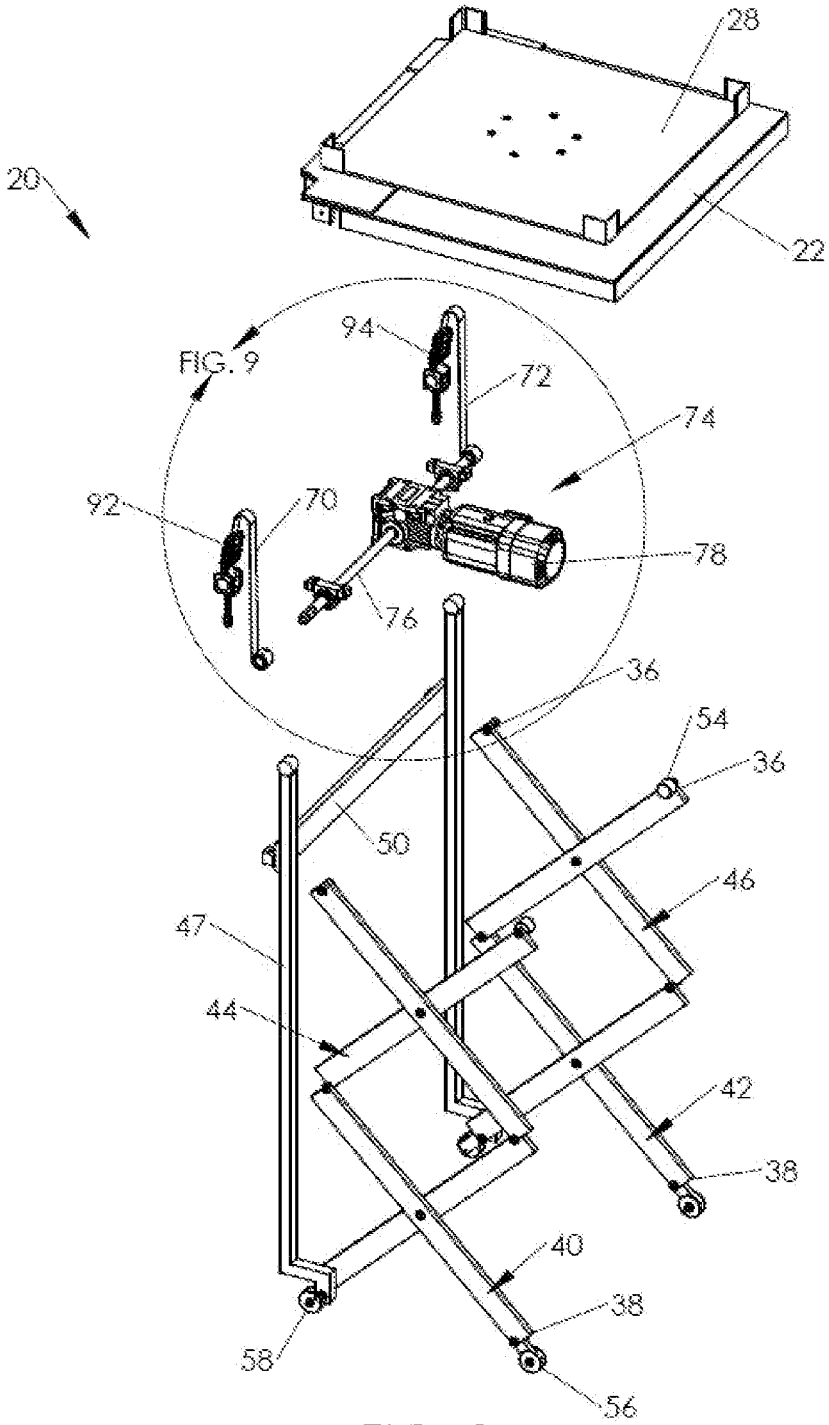
FIG. 8 is an exploded view of the lift assembly.
Figure 9:
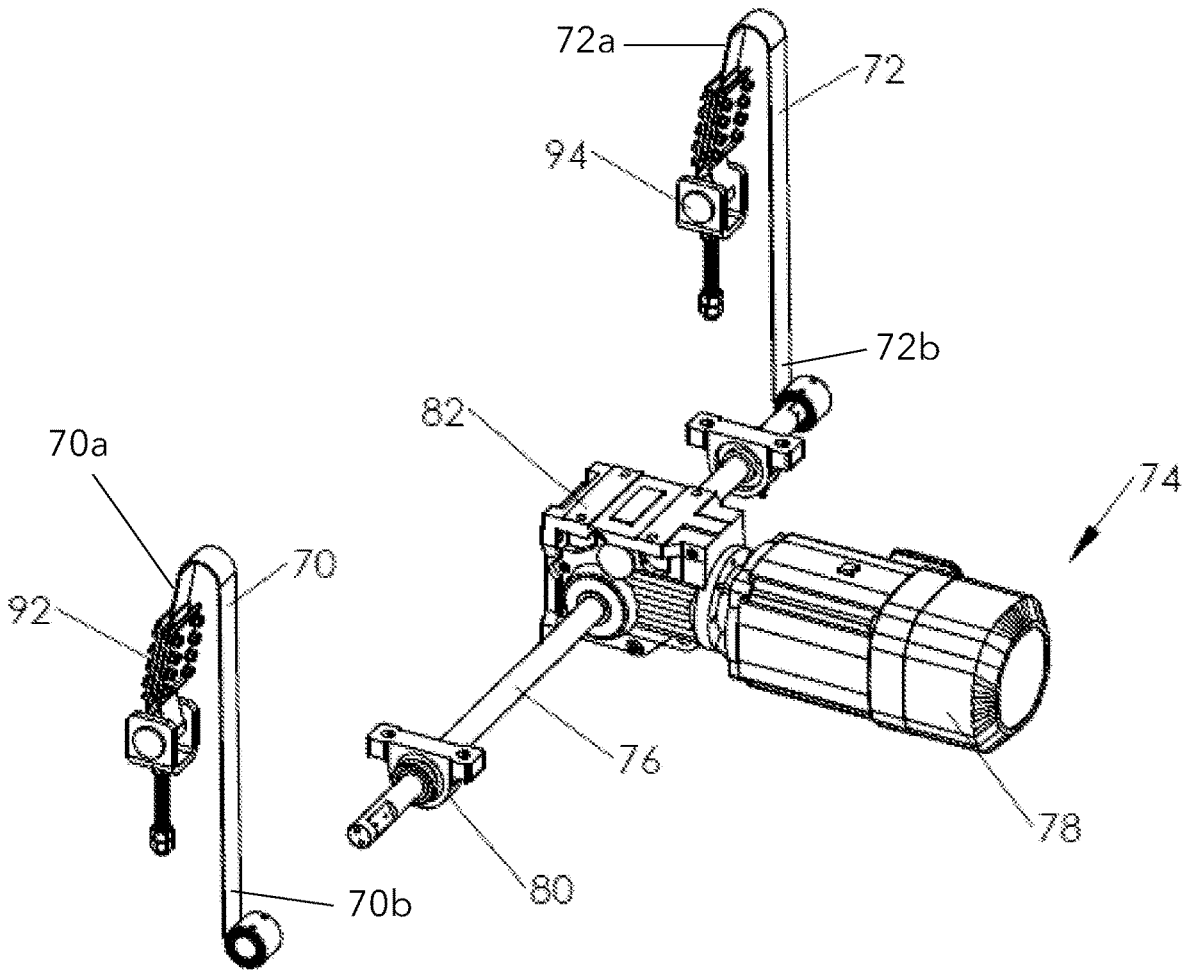
FIG. 9 is a detailed view of FIG. 8 illustrating the drive mechanism and the flexible member.

As shown in FIGS. 7-9, the lift assembly 20 includes a first flexible member 70 coupled to the first stanchion 47 and a second flexible member 72 coupled to the second stanchion 48. The first and second flexible members 70, 72 may comprise a belt, a cable, a chain, a rope, or any other flexible elongated member capable of being wound. The lift assembly 20 includes a drive mechanism 74 mounted to the platform 22. The drive mechanism 74 is coupled to the first and second flexible members 70, 72 to wind and unwind the flexible members 70, 72 to move the platform 22 between the raised and lowered positions 24, 26. The drive mechanism 74 is mounted to the platform 22 such that the drive mechanism 74 moves with the platform 22 while the platform 22 moves between the raised and lowered positions 24, 26. The drive mechanism 74 may include a driveshaft 76 coupled to the flexible members 70, 72 and a drive motor 78 mounted to the platform 22. The drive motor 78 may be rotatably coupled to the driveshaft 76 and the drive motor 78 may rotate the driveshaft 76 to wind and unwind the flexible members 70, 72 about the driveshaft 76 to move the platform 22 with the drive motor 78 between the raised and lowered positions 24, 26. The drive mechanism 74 is mounted to the platform 22, so that occlusion defined by the platform 22 and the scissor arm system 32 is mitigated.

Figure 10:
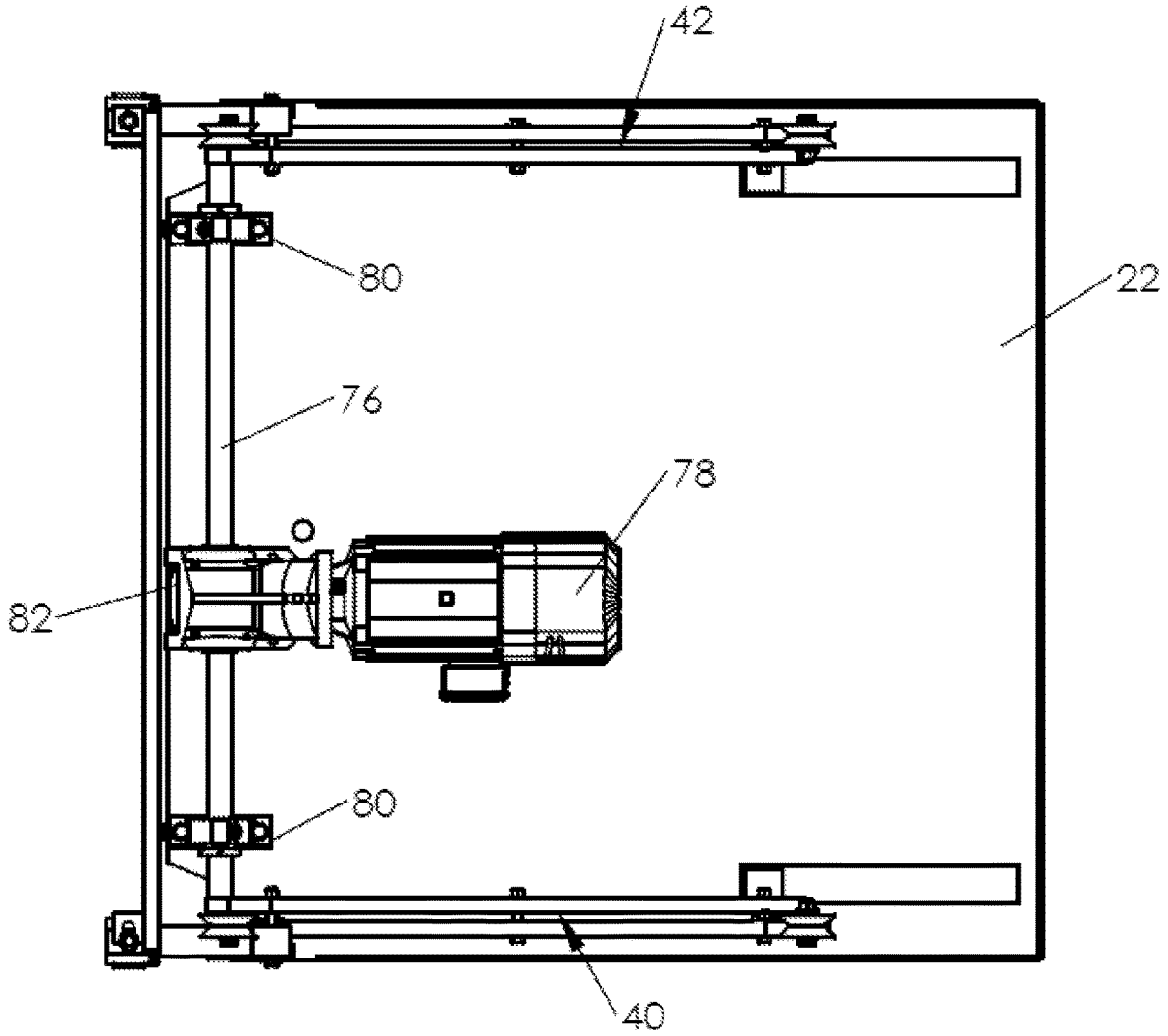
FIG. 10 is a bottom plan view of the lift assembly.

As shown in FIGS. 8-10, one or more bearings 80 may be mounted to the driveshaft 76 and the platform 22 to constrain the driveshaft 76 relative to the platform 22. In some configurations, a gear assembly 82 may be coupled to the drive motor 78 and the driveshaft 76 to transfer torque between the drive motor 78 and the driveshaft 76. In the illustrated configuration, the drive mechanism 74 includes a single motor and a single driveshaft. It is also contemplated that only a single flexible member is provided to facilitate winding and unwinding to raise and lower the platform 22 In other configurations, the drive mechanism 74 may include more than one motor and/or more than one driveshaft. One or more spools (not shown) may be coupled to the driveshaft 76 to capture the flexible members 70, 72 as the drive mechanism 74 winds the flexible members 70, 72 about the driveshaft 76. It is contemplated that other drive mechanisms may be used to wind and unwind the flexible members 70, 72 to move the platform 22 to the raised and lowered positions 24, 26.

As shown in FIGS. 6 and 7, the first and second stanchions 47, 48 each have a front surface 84, 86 facing the platform 22 and a back surface 88, 90 facing away from the platform 22. The flexible members 70, 72 each have a proximal portion adjacent a proximal end 70*a*, 72*a* of the flexible members 70, 72 that may be coupled to the respective stanchion 47, 48 adjacent the back surface 88, 90 of the stanchion 47, 48. The flexible members 70, 72 each have a distal portion adjacent a distal end 70*b*, 72*b* of the flexible members 70, 72 that is coupled to the drive mechanism 74 adjacent the front surfaces 84, 86 of the stanchions 47, 48. More specifically, the flexible members 70, 72 may be coupled to pretensioners 92, 94 that are mounted to the back surfaces 88, 90 of the stanchions 47, 48 and routed above the second ends 47*b*, 48*b* of the stanchions 47, 48 such that the flexible members 70, 72 are disposed above the second ends 47*b*, 48*b* of the stanchions 47, 48. The pretensioners 92, 94 may be used to adjust a tilt of the platform 22 relative to the stanchions 47, 48. The flexible members 70, 72 may hang down from the second ends 47*b*, 48*b* of the stanchions 47, 48 along the elongated portions 62, 64 of the stanchions 47, 48 and be coupled to the drive mechanism 74. Tension of the flexible members 70, 72 is established from supporting the platform 22 and/or the load supported by the platform 22. Since the flexible members 70, 72 hang down along the front surfaces 84, 86 of the elongated portions 62, 64 of the stanchions 47, 48, the flexible members 70, 72 are disposed between the pivot axis PA and the stanchion axis SA, which mitigates a moment imparted on the support feet 58, 60 from the stanchions 47, 48, the platform 22, and the load.

A method of moving the platform 22 of the lift assembly 20 is also presented. The platform 22 is supported by at least one flexible member 70 coupled to at least one stanchion 47. The platform 22 is supported above the scissor arm system 32. First and second scissor arms 40*a*, 40*b* of the first pair of scissor arms 40 of the scissor arm system 32 are pivotably connected to each other. The first scissor arm 40*a* is pivotably coupled to the stanchion 47. The method includes the step of winding the flexible member 70 to raise the platform 22 relative to the stanchion 47 while the first scissor arm 40*a* pivots relative to the second scissor arm 40*b* and the stanchion 47. The step of winding the flexible member 70 further includes winding the flexible member 70 about the driveshaft 76 coupled to the drive motor 78 mounted to the platform 22. The method may also include the step of unwinding the flexible member 70 to lower the platform 22 relative to the stanchion 47 while the first scissor arm 40*a* pivots relative to the second scissor arm 40*b* and the stanchion 47.

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A lift assembly comprising:

a platform movable to a raised position, a lowered position, and at least one intermediate position between said raised and lowered positions;

a scissor arm system defining a cavity bounded above by said platform and having a first pair of scissor arms pivotably connected to each other and a second pair of scissor arms pivotably connected to each other and spaced from said first pair of scissor arms to further define said cavity with said scissor arm system having opposed first and second ends with said first ends of said scissor arm system being coupled to said platform;

a stanchion extending from a first stanchion end to a second stanchion end above said first stanchion end with said stanchion guiding said platform between said positions;

a flexible member coupled to said stanchion; and a drive mechanism mounted to said platform to move with said platform and coupled to said flexible member to wind and unwind said flexible member to move said platform between said raised and lowered positions;

wherein said cavity defined beneath said platform by said scissor arm system is free of interconnecting structure between said first and second pairs of scissor arms.

2. The lift assembly of claim 1, wherein said stanchion is further defined as a first stanchion with said first stanchion coupled to one of said first pair of scissor arms and said lift assembly further comprises a second stanchion spaced from said first stanchion and coupled to one of said second pair of scissor arms.

3. The lift assembly of claim 2, further comprising a cross-member coupled to and extending between said first and second stanchions.

4. The lift assembly of claim 1, wherein said scissor arm system further comprises a third pair of scissor arms coupled in series to said first pair of scissor arms and a fourth pair of scissor arms coupled in series to said second pair of scissor arms with said third and fourth pair of scissor arms further defining said cavity.

5. The lift assembly of claim 1, wherein one of said second ends of said scissor arm system is pivotably coupled to said stanchion proximal said first end of said stanchion to pivot about a pivot axis.

6. The lift assembly of claim 5, further comprising a support foot to support said scissor arm system with said support foot coupled to one of said second ends of said scissor arm system.

7. The lift assembly of claim 6, wherein said support foot revolves around said pivot axis.

8. The lift assembly of claim 6, wherein said support foot comprises a wheel.

9. The lift assembly of claim 6, further comprising a base to support said stanchion and said scissor arm system.

10. The lift assembly of claim 9, wherein said base has a track to guide said support foot and said scissor arm system along a length of said base.

11. The lift assembly of claim 5, wherein said stanchion has an elongated portion proximal said second end of said stanchion extending along a stanchion axis and a support portion proximal said first end of said stanchion extending forward away from said stanchion axis with said one of said second ends of said scissor arm system pivotably coupled to said support portion of said stanchion.

12. The lift assembly of claim 1, wherein said drive mechanism comprises a driveshaft coupled to said flexible member and a drive motor mounted to said platform and rotatably coupled to said driveshaft with said drive motor rotating said driveshaft to wind and unwind said flexible member about said driveshaft to move said platform with said drive motor between said positions.

13. The lift assembly of claim 1, wherein said stanchion has a front surface facing said platform and a back surface facing away from said platform, and wherein said flexible member has a proximal portion adjacent a proximal end of said flexible member coupled to said stanchion adjacent said back surface of said stanchion and said flexible member has a distal portion adjacent a distal end of said flexible member coupled to said drive mechanism adjacent said front surface of said stanchion.

14. The lift assembly of claim 13, wherein said flexible member is disposed above said second end of said stanchion.

15. The lift assembly of claim 1, wherein one of said first ends of said scissor arm system is pivotably coupled to said platform, and wherein another of said first ends of said scissor arm system is slidably coupled to said platform.

16. The lift assembly of claim 1, wherein said platform has a planar surface to support a load with said planar surface being transverse to said stanchion.

17. A lift assembly comprising:

a platform movable to a raised position, a lowered position, and at least one intermediate position between said raised and lowered positions;

a scissor arm system defining a cavity bounded above by said platform and having one pair of scissor arms pivotably connected to each other with said scissor arm system having opposed first and second ends with said first ends of said scissor arm system coupled to said platform;

a stanchion extending from a first stanchion end to a second stanchion end above said first stanchion end with said stanchion guiding said platform between said positions and with said stanchion having an elongated portion proximal said second end of said stanchion extending along a stanchion axis and a support portion proximal said first end of said stanchion extending forward away from said stanchion axis;

a flexible member coupled to said stanchion; and a drive mechanism mounted to said platform to move with said platform and coupled to said flexible member to wind and unwind said flexible member to move said platform between said raised and lowered positions;

and wherein one of said second ends of said scissor arm system is pivotably coupled to said support portion of said stanchion to pivot about a pivot axis.

18. The lift assembly of claim 17, wherein said platform moves along said elongated portion of said stanchion between said raised and lowered positions.

19. A lift assembly comprising:

a platform movable to a raised position, a lowered position, and at least one intermediate position between said raised and lowered positions;

a scissor arm system defining a cavity bounded above by said platform and having a first pair of scissor arms pivotably connected to each other and a second pair of scissor arms pivotably connected to each other and spaced from said first pair of scissor arms to further define said cavity with said scissor arm system having opposed first and second ends with said first ends of said scissor arm system coupled to said platform;

a stanchion extending from a first stanchion end to a second stanchion end above said first stanchion end with said stanchion guiding said platform between said positions;

a flexible member coupled to said stanchion; and a drive mechanism comprising a driveshaft coupled to said flexible member and a drive motor mounted to said platform to move with said platform with said drive motor rotatably coupled to said driveshaft and said drive motor rotating said driveshaft to wind and unwind said flexible member about said driveshaft to move said platform between said raised and lowered positions with said drive motor within said cavity and between said first and second pairs of scissor arms.

* * * * *